US007185719B2

(12) United States Patent
van Riet

(10) Patent No.: US 7,185,719 B2
(45) Date of Patent: Mar. 6, 2007

(54) DYNAMIC ANNULAR PRESSURE CONTROL APPARATUS AND METHOD

(75) Inventor: Egbert Jan van Riet, Rijswijk (NL)

(73) Assignee: Shell Oil Company, Houston, TX (US)

( * ) Notice: Subject to any disclaimer, the term of this patent is extended or adjusted under 35 U.S.C. 154(b) by 229 days.

(21) Appl. No.: 10/775,425

(22) Filed: Feb. 10, 2004

(65) Prior Publication Data

US 2004/0178003 A1 Sep. 16, 2004

Related U.S. Application Data

(63) Continuation-in-part of application No. 10/368,128, filed on Feb. 18, 2003, now Pat. No. 6,904,981.

(60) Provisional application No. 60/358,226, filed on Feb. 20, 2002.

(30) Foreign Application Priority Data

Aug. 1, 2003 (EP) ..... PCT/EP03/08644

(51) Int. Cl.
*E21B 21/08* (2006.01)

(52) U.S. Cl. ..... 175/66; 175/207; 166/265

(58) Field of Classification Search ..... 175/66, 175/206, 207; 166/265
See application file for complete search history.

(56) References Cited

U.S. PATENT DOCUMENTS

| | | | | |
|---|---|---|---|---|
| 2,169,223 | A | 8/1939 | Christian | 255/61 |
| 2,628,129 | A | 2/1953 | Hosmer et al. | |
| 2,946,565 | A | 7/1960 | Williams | 255/1.8 |
| 3,354,970 | A | 11/1967 | Lummus | 175/218 |
| 3,365,009 | A | 1/1968 | Burnham et al. | 175/206 |
| 3,429,387 | A | 2/1969 | Brown | 175/237 |
| 3,443,643 | A | 5/1969 | Jones | 175/25 |
| 3,470,971 | A | 10/1969 | Dower | 175/25 |
| 3,488,765 | A | 1/1970 | Anderson | 175/61 |
| 3,497,020 | A | 2/1970 | Kammerer, Jr. | 175/69 |
| 3,508,577 | A | 4/1970 | Vincent et al. | 137/528 |
| 3,552,502 | A | 1/1971 | Wilson, Sr. | 175/25 |
| 3,559,739 | A | 2/1971 | Hutchison | 166/311 |
| 3,677,353 | A | 7/1972 | Baker | 175/25 |
| 3,827,511 | A | 8/1974 | Jones | 175/25 |
| 3,868,832 | A | 3/1975 | Biffle | 64/23.5 |
| 4,315,553 | A | 2/1982 | Stallings | 175/207 |
| 4,406,595 | A | 9/1983 | Robertson et al. | 417/383 |
| 4,630,675 | A | 12/1986 | Neipling et al. | 166/53 |
| 4,630,691 | A | 12/1986 | Hooper | 175/65 |
| 4,653,597 | A | 3/1987 | Johnson | 175/25 |
| 4,683,944 | A | 8/1987 | Curlett | 166/65.1 |
| 4,700,739 | A | 10/1987 | Flohr | 137/488 |
| 4,709,900 | A | 12/1987 | Dyhr | 251/5 |
| 4,755,111 | A | 7/1988 | Cocchi et al. | 417/394 |

(Continued)

FOREIGN PATENT DOCUMENTS

DE 19813087 9/1999

(Continued)

*Primary Examiner*—Frank S. Tsay

(57) ABSTRACT

A drilling system for drilling a bore hole into a subterranean earth formation, wherein at least a portion of the mud flow from the primary mud pump is diverted to the mud discharge outlet, thereby creating a backpressure system to readily increase annular pressure.

8 Claims, 3 Drawing Sheets

U.S. PATENT DOCUMENTS

| | | | | |
|---|---|---|---|---|
| 4,924,949 | A | 5/1990 | Curlett | 175/25 |
| 5,010,966 | A * | 4/1991 | Stokley et al. | 175/66 |
| 5,048,620 | A | 9/1991 | Maher | 175/71 |
| 5,168,932 | A | 12/1992 | Worrall et al. | 166/336 |
| 5,305,836 | A | 4/1994 | Holbrook et al. | 175/39 |
| 5,348,107 | A | 9/1994 | Bailey et al. | 175/162 |
| 5,437,308 | A | 8/1995 | Morin et al. | 138/46 |
| 5,443,128 | A | 8/1995 | Amaudric du Chaffaut | 175/25 |
| 5,447,197 | A | 9/1995 | Rae et al. | 166/293 |
| 5,474,142 | A | 12/1995 | Bowden | 175/27 |
| 5,547,506 | A | 8/1996 | Rae et al. | 106/730 |
| 5,638,904 | A | 6/1997 | Misselbrook et al. | 166/384 |
| 5,806,612 | A | 9/1998 | Vorhoff et al. | 175/40 |
| 5,857,522 | A * | 1/1999 | Bradfield et al. | 166/267 |
| 5,890,549 | A | 4/1999 | Sprehe | 175/71 |
| 5,975,219 | A | 11/1999 | Sprehe | 175/48 |
| 6,033,192 | A | 3/2000 | Wood | 417/395 |
| 6,035,952 | A | 3/2000 | Bradfield et al. | 175/66 |
| 6,102,673 | A | 8/2000 | Mott et al. | 417/392 |
| 6,119,772 | A | 9/2000 | Pruet | 166/81.1 |
| 6,176,323 | B1 * | 1/2001 | Weirich et al. | 175/40 |
| 6,189,612 | B1 * | 2/2001 | Ward | 166/250.07 |
| 6,325,159 | B1 | 12/2001 | Peterman et al. | 175/7 |
| 6,352,129 | B1 | 3/2002 | Best | 175/25 |
| 6,367,566 | B1 | 4/2002 | Hill | 175/57 |
| 6,374,925 | B1 * | 4/2002 | Elkins et al. | 175/25 |
| 6,394,195 | B1 | 5/2002 | Schubert et al. | 175/69 |
| 6,412,554 | B1 | 7/2002 | Allen et al. | 166/80.1 |
| 6,484,816 | B1 | 11/2002 | Koederitz | 175/25 |
| 6,571,873 | B2 | 6/2003 | Maus | 166/250.07 |
| 6,575,244 | B2 | 6/2003 | Chang et al. | 166/250.15 |
| 2001/0050185 | A1 | 12/2001 | Calder et al. | 175/5 |
| 2002/0108783 | A1 | 8/2002 | Elkins et al. | 175/25 |
| 2002/0112888 | A1 | 8/2002 | Leuchtenberg | 175/48 |
| 2003/0098181 | A1 | 5/2003 | Aronstam et al. | 175/65 |
| 2003/0181338 | A1 | 9/2003 | Sweatman et al. | 507/100 |
| 2004/0069504 | A1 | 4/2004 | Krueger et al. | 166/387 |

FOREIGN PATENT DOCUMENTS

| | | | |
|---|---|---|---|
| EP | 436242 | B1 | 4/1994 |
| EP | 947750 | A2 | 10/1998 |
| GB | 2323870 | A | 10/1998 |
| WO | 98/16716 | | 10/1997 |
| WO | 99/34090 | | 7/1999 |
| WO | 00/04269 | | 1/2000 |
| WO | 00/75477 | A1 | 12/2000 |
| WO | 00/79092 | A2 | 12/2000 |
| WO | 01/20120 | A1 | 3/2001 |
| WO | 02/50398 | A1 | 6/2002 |
| WO | 02/084067 | A1 | 10/2002 |
| WO | 03/025334 | A1 | 3/2003 |
| WO | 03/071091 | A1 | 8/2003 |
| WO | 04/005667 | A1 | 1/2004 |
| WO | 04/074627 | A1 | 9/2004 |

* cited by examiner

DYNAMIC ANNULAR PRESSURE CONTROL APPARATUS AND METHOD

PRIORITY CLAIM

The present application is a continuation in part of U.S. application Ser. No. 10/368,128, filed 18 Feb. 2003, now U.S. Pat. No. 6,904,981 which application claims benefit of U.S. Provisional application 60/358,226 filed Feb. 20, 2002. In addition, under 35 USC § 120, the present continuation-in-part application claims priority of International application PCT/EP03/08644 filed on Aug. 1, 2003.

FIELD OF THE INVENTION

The present invention is related to a method and an apparatus for dynamic well borehole annular pressure control, more specifically, a selectively closed-loop, pressurized method for controlling borehole pressure during drilling and well completion.

BACKGROUND OF THE ART

The exploration and production of hydrocarbons from subsurface formations ultimately requires a method to reach and extract the hydrocarbons from the formation. This is typically achieved by drilling a well with a drilling rig. In its simplest form, this constitutes a land-based drilling rig that is used to support and rotate a drill string, comprised of a series of drill tubulars with a drill bit mounted at the end. Furthermore, a pumping system is used to circulate a fluid, comprised of a base fluid, typically water or oil, and various additives down the drill string, the fluid then exits through the rotating drill bit and flows back to surface via the annular space formed between the borehole wall and the drill bit. The drilling fluid serves the following purposes: (a) Provide support to the borehole wall, (b) prevent formation fluids or gasses from entering the well, (c) transport the cuttings produced by the drill bit to surface, (d) provide hydraulic power to tools fixed in the drill string and (d) cooling of the bit. After being circulated through the well, the drilling fluid flows back into a mud handling system, generally comprised of a shaker table, to remove solids, a mud pit and a manual or automatic means for addition of various chemicals or additives to keep the properties of the returned fluid as required for the drilling operation. Once the fluid has been treated, it is circulated back into the well via re-injection into the top of the drill string with the pumping system.

During drilling operations, the fluid exerts a pressure against the wellbore wall that is mainly built-up of a hydrostatic part, related to the weight of the mud column, and a dynamic part related frictional pressure losses caused by, for instance, the fluid circulation rate or movement of the drill string. The total pressure (dynamic+static) that the fluid exerts on the wellbore wall is commonly expressed in terms of equivalent density, or "Equivalent Circulating Density" (or ECD). The fluid pressure in the well is selected such that, while the fluid is static or during drilling operations, it does not exceed the formation fracture pressure or formation strength. If the formation strength is exceeded, formation fractures will occur which will create drilling problems such as fluid losses and borehole instability. On the other hand, the fluid density is chosen such that the pressure in the well is always maintained above the pore pressure to avoid formation fluids entering the well (primary well control) The pressure margin with on one side the pore pressure and on the other side the formation strength is known as the "Operational Window".

For reasons of safety and pressure control, a Blow-Out Preventer (BOP) can be mounted on the well head, below the rig floor, which BOP can shut off the wellbore in case unwanted formation fluids or gas should enter the wellbore (secondary well control). Such unwanted inflows are commonly referred to as "kicks". The BOP will normally only be used in emergency i.e. well-control situations.

To overcome the problems of Over-Balanced, open fluid circulation systems, there have been developed a number of closed fluid handling systems. Examples of these include U.S. Pat. No. 6,035,952, to Bradfield et al. and assigned to Baker Hughes Incorporated. In this patent, a closed system is used for the purposes of underbalanced drilling, i.e., the annular pressure is maintained below the formation pore pressure.

Another method and system is described by H. L. Elkins in U.S. Pat. Nos. 6,374,925 and 6,527,062. That invention traps pressure within the annulus by completely closing the annulus outlet when circulation is interrupted.

The current invention further builds on the invention described in U.S. Pat. No. 6,352,129 by Shell Oil Company, which is hereby incorporated by reference. In this patent a method and system are described to control the fluid pressure in a well bore during drilling, using a back pressure pump in fluid communication with an annulus discharge conduit, in addition to a primary pump for circulating drilling fluid through the annulus via the drill string.

SUMMARY OF THE PRESENT INVENTION

According to the present invention there is provided a drilling system for drilling a bore hole into a subterranean earth formation, wherein one may readily control annular pressure. Whereas, U.S. Pat. No. 6,352,129 utilizes a back-pressure pump to pump mud back into the discharge outlet, the present invention utilizes the primary mud pump and diverts at least a portion of the mud flow to the discharge outlet to increase annular pressure.

In one embodiment of the present invention, a three-way valve is utilized to completely divert the flow of mud from the primary mud pump to the discharge outlet.

In another embodiment of the present invention, a valve may be used to split the flow of mud from the mud pump to provide flow to both the discharge outlet and the drill string.

In yet another embodiment, flow is divided between the drill string and the discharge outlet, with each conduit having a variable flow control device in the fluid conduit.

Since according to the invention the pump is utilized for both supplying drilling fluid to the longitudinal fluid passage in the drill string and for exerting a back pressure in the fluid discharge conduit, a separate backpressure pump can be dispensed with.

BRIEF DESCRIPTION OF THE DRAWINGS

The invention will be described hereinafter in more detail and by way of example with reference to the accompanying drawing, in which.

DETAILED DESCRIPTION OF THE EMBODIMENTS

The present invention is intended to achieve Dynamic Annulus Pressure Control (DAPC) of a well bore during drilling, completion and intervention operations.

Figure 1:
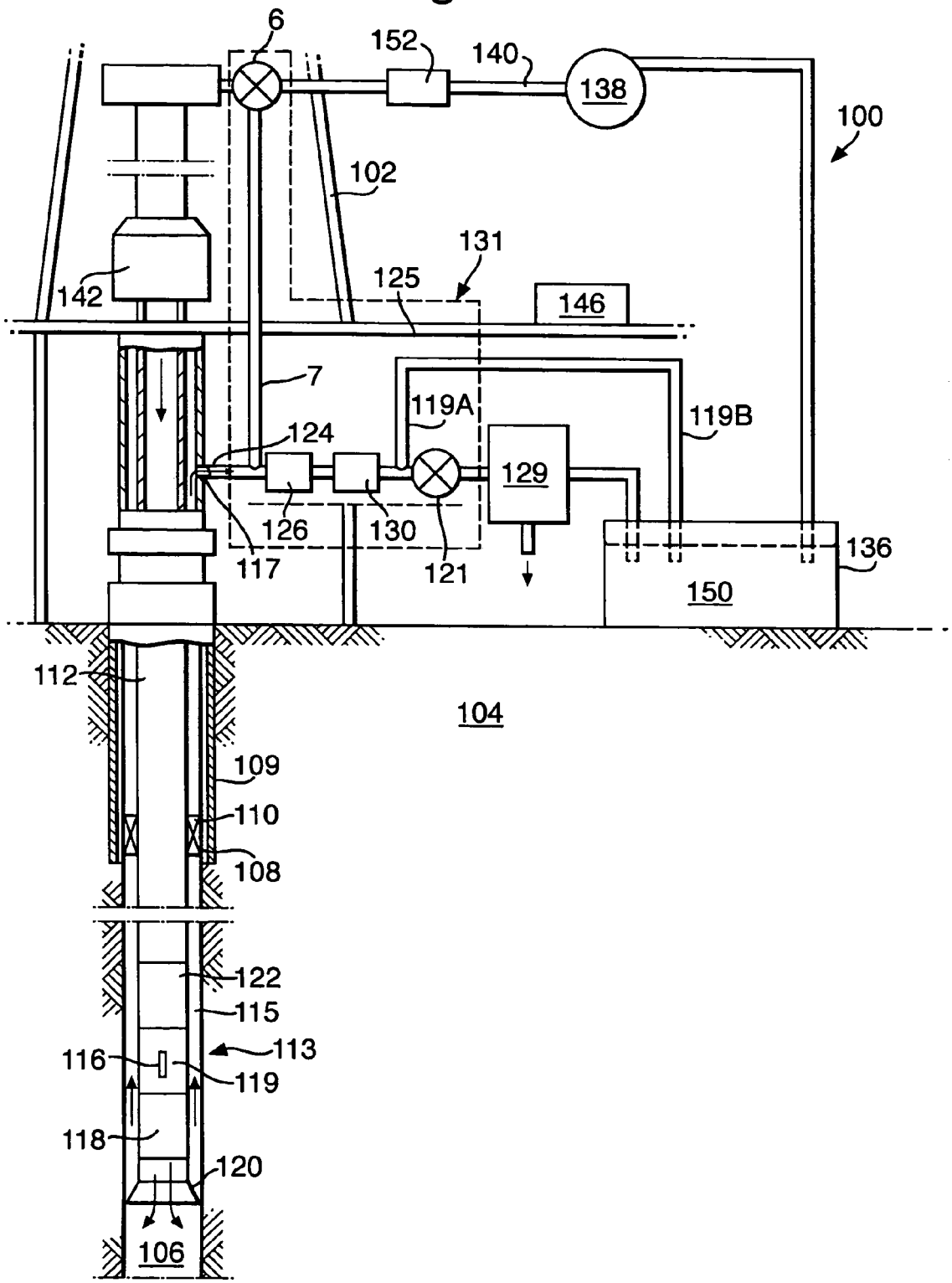
FIG. 1 is a schematic view of an embodiment of the apparatus of the invention.
Figure 2:
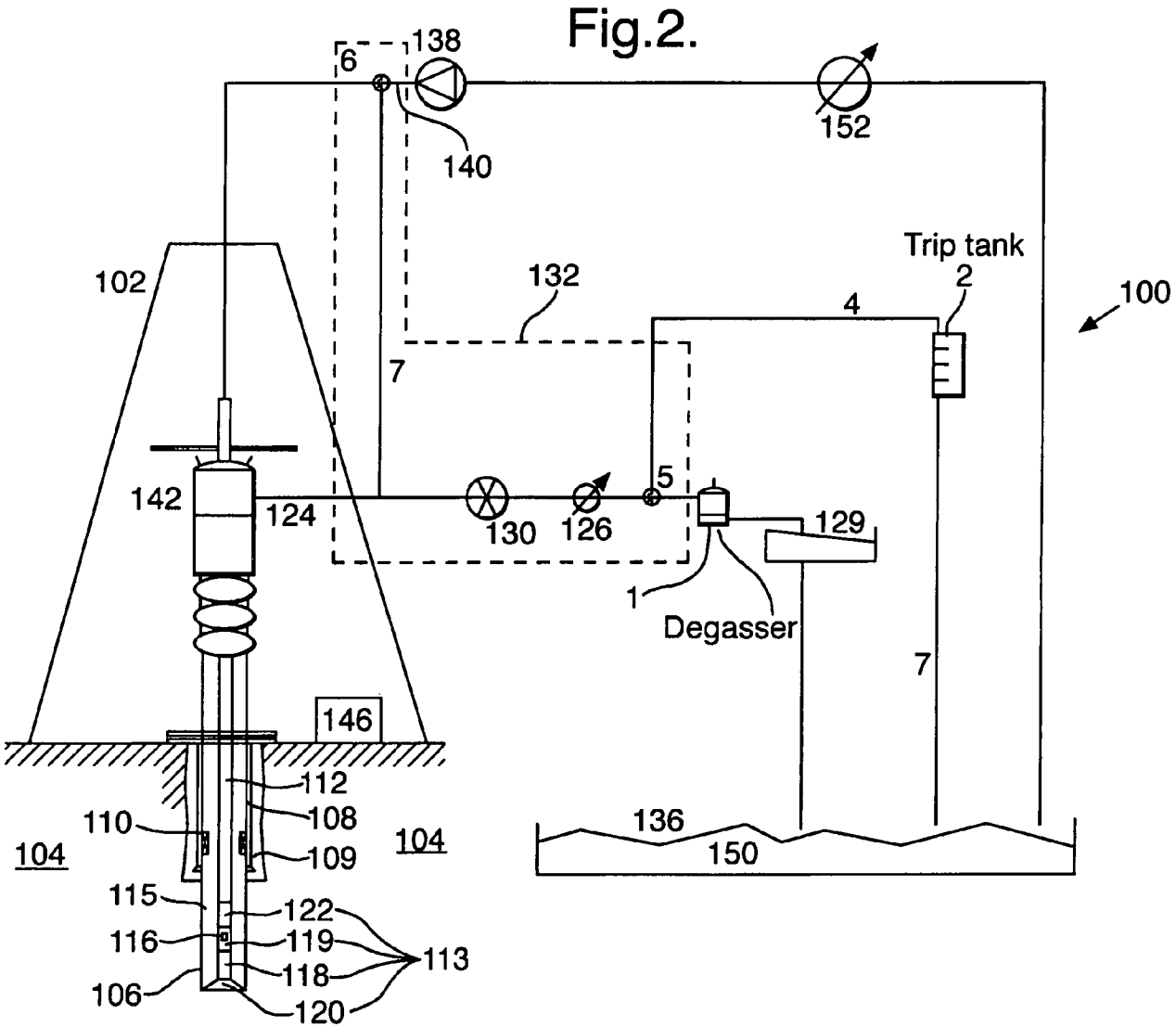
FIG. 2 is a schematic view of another embodiment of the apparatus according to the invention.
Figure 3:
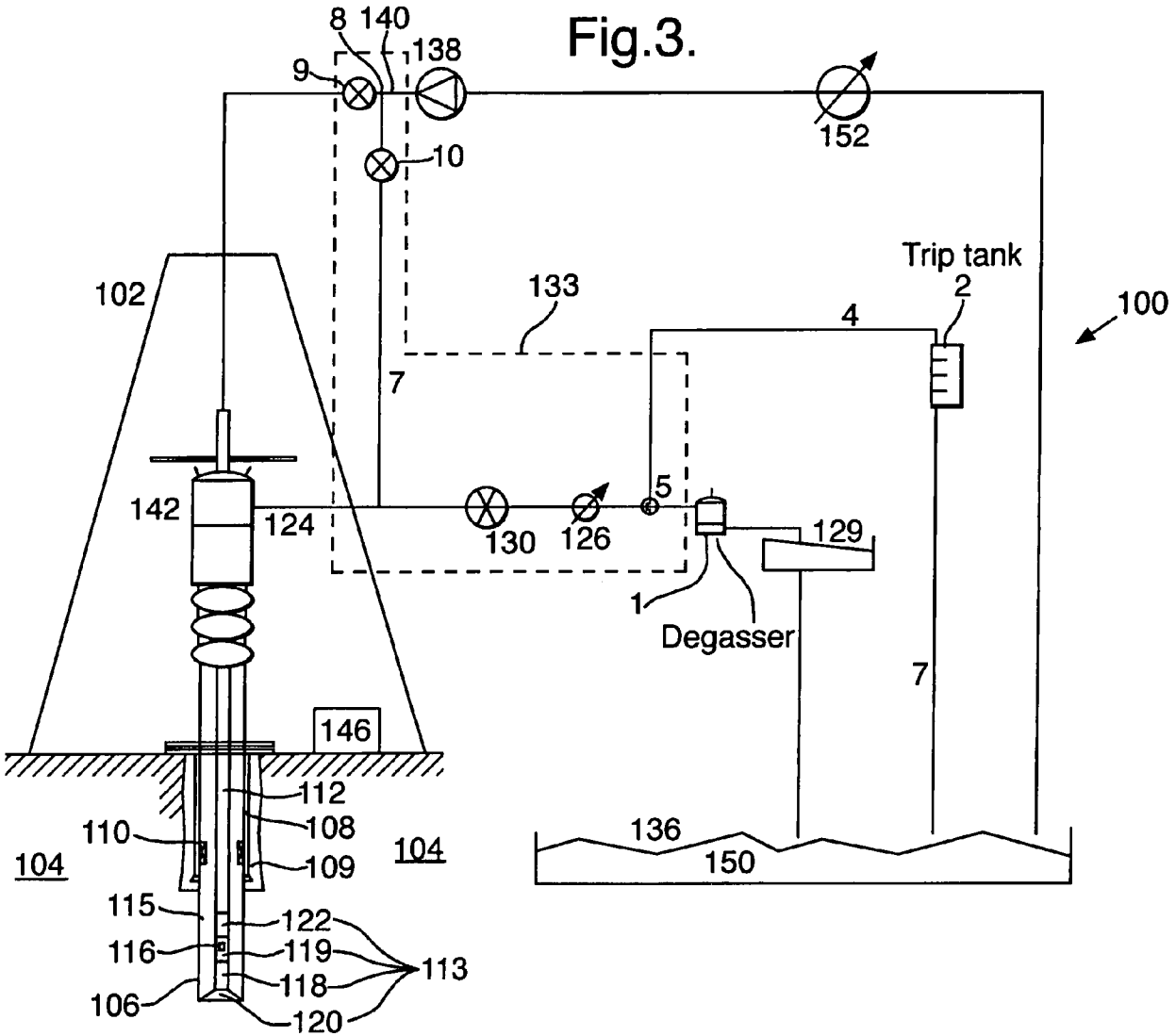
FIG. 3 is a schematic view of still another embodiment of the apparatus according to the invention.

FIGS. 1 to 3 are a schematic views depicting surface drilling systems employing embodiments of the current invention. It will be appreciated that an offshore drilling system may likewise employ the current invention. In the figures, the drilling system 100 is shown as being comprised of a drilling rig 102 that is used to support drilling operations. Many of the components used on a rig 102, such as the kelly, power tongs, slips, draw works and other equipment are not shown for ease of depiction. The rig 102 is used to support drilling and exploration operations in formation 104. The borehole 106 has already been partially drilled, casing 108 set and cemented 109 into place. In the preferred embodiment, a casing shutoff mechanism, or downhole deployment valve, 110 is installed in the casing 108 to optionally shut-off the annulus and effectively act as a valve to shut off the open hole section when the entire drill string is located above the valve.

The drill string 112 supports a bottom hole assembly (BHA) 113 that includes a drill bit 120, a mud motor 118, a MWD/LWD sensor suite 119, including a pressure transducer 116 to determine the annular pressure, a check valve 118, to prevent backflow of fluid from the annulus. It also includes a telemetry package 122 that is used to transmit pressure, MWD/LWD as well as drilling information to be received at the surface.

As noted above, the drilling process requires the use of a drilling fluid 150, which is stored in reservoir 136. The reservoir 136 is in fluid communication with one or more mud pumps 138 which pump the drilling fluid 150 through conduit 140. An optional flow meter 152 can be provided in series with the one or more mud pumps, either upstream or downstream thereof. The conduit 140 is connected to the last joint of the drill string 112 that passes through a rotating control head on top of the BOP 142. The rotating control head on top of the BOP forms, when activated, a seal around the drill string 112, isolating the pressure, but still permitting drill string rotation and reciprocation. The fluid 150 is pumped down through the drill string 112 and the BHA 113 and exits the drill bit 120, where it circulates the cuttings away from the bit 120 and returns them up the open hole annulus 115 and then the annulus formed between the casing 108 and the drill string 112. The fluid 150 returns to the surface and goes through the side outlet below the seal of the rotating head on top of the BOP, through conduit 124 and optionally through various surge tanks and telemetry systems (not shown).

Thereafter the fluid 150 proceeds to what is generally referred to as the backpressure system 131, 132, 133. The fluid 150 enters the backpressure system 131, 132, 133, and flows through an optional flow meter 126. The flow meter 126 may be a mass-balance type or other high-resolution flow meter. Utilizing the flow meter 126 and 152, an operator will be able to determine how much fluid 150 has been pumped into the well through drill string 112 and the amount of fluid 150 returning from the well. Based on differences in the amount of fluid 150 pumped versus fluid 150 returned, the operator is able to determine whether fluid 150 is being lost to the formation 104, i.e., a significant negative fluid differential, which may indicate that formation fracturing has occurred. Likewise, a significant positive differential would be indicative of formation fluid or gas entering into the well bore (kick).

The fluid 150 proceeds to a wear resistant choke 130 provided in conduit 124. It will be appreciated that there exist chokes designed to operate in an environment where the drilling fluid 150 contains substantial drill cuttings and other solids. Choke 130 is one such type and is further capable of operating at variable pressures, flowrates and through multiple duty cycles.

Referring now to the embodiment of FIG. 1, the fluid exits the choke 150 and flows through valve 121. The fluid 150 is then processed by a series of filters and shaker table 129, designed to remove contaminates, including cuttings, from the fluid 150. The fluid 150 is then returned to reservoir 136.

Still referring to FIG. 1, a three-way valve 6 is placed in conduit 140 downstream of the rig pump 138 and upstream of the longitudinal drilling fluid passage of drill string 112. A bypass conduit 7 fluidly connects rig pump 138 with the drilling fluid discharge conduit 124 via the three-way valve 6, thereby bypassing the longitudinal drilling fluid passage of drill string 112. This valve 6 allows fluid from the rig pumps to be completely diverted from conduit 140 to conduit 7, not allowing flow from the rig pump 138 to enter the drill string 112. By maintaining pump action of pump 138, sufficient flow through the manifold 130 to control backpressure, is ensured.

In the embodiments of FIGS. 2 and 3, the fluid 150 exits the choke 130 and flows through valve 5. Valve 5 allows fluid returning from the well to be directed through the degasser 1 and solids separation equipment 129 or to be directed to reservoir 2, which can be a trip tank. Optional degasser 1 and solids separation equipment 129 are designed to remove excess gas contaminates, including cuttings, from the fluid 150. After passing solids separation equipment 129, the fluid 150 is returned to reservoir 136.

A trip tank is normally used on a rig to monitor fluid gains and losses during tripping operations. In the present invention, this functionality is maintained.

Operation of valve 6 in the embodiment of FIG. 2 is similar to that of valve 6 in FIG. 1. Valve 6 may be a controllable variable valve, allowing a variable partition of the total pump output to be delivered to conduit 140 and the longitudinal drilling fluid passage in drill string 112 on one side, and to bypass conduit 7 on the other side. This way, the drilling fluid can be pumped both into the longitudinal drilling fluid passage of the drill string 112 and into the back pressure system 130, 131, 132.

In operation, the mud pump 138 thus delivers a pressure for exceeding the drill string circulation pressure losses and annular circulation pressure losses, and for providing annulus back pressure. Pending on a set back-pressure, variable valve 6 is opened to allow mud flow into bypass conduit 7 for achieving the desired back pressure. Valve 6, or choke 130 if provided, or both, are adjusted to maintain the desired back pressure.

A three-way valve may be provided in the form as shown in FIG. 3, where a three way fluid junction 8 is provided in conduit 140, and whereby a first variable flow restricting device 9 is provided between the three way fluid junction 8 and the longitudinal drilling fluid passage, and a second variable flow restricting device 10 is provided between the three way fluid junction 8 and the fluid discharge conduit 124.

The ability to provide adjustable backpressure during the entire drilling and completing process is a significant improvement over conventional drilling systems.

It will be appreciated that it is necessary to shut off the drilling fluid circulation through the longitudinal fluid passage in drill string 112 and the annulus 115 from time to time during the drilling process, for instance to make up successive drill pipe joints. When the drilling fluid circulation is is shut off, the annular pressure will reduce to the hydrostatic pressure. Similarly, when the circulation is regained, the annular pressure increases. The cyclic loading of the borehole wall can cause fatigue.

The use of the invention permits an operator to continuously adjust the annular pressure by adjusting the backpressure at surface by means of adjusting choke 130, and/or valve 6 and/or first and second variable flow restrictive devices 9,10. In this manner, the downhole pressure can be varied in such a way that the downhole pressure remains essentially constant and within the operational window limited by the pore pressure and the fracture pressure. It will be appreciated that the difference between the thus maintained annular pressure and the pore pressure, known as the overbalance pressure, can be significantly less than the overbalance pressure seen using conventional methods.

In all of the embodiments of FIGS. 1 to 3 a separate backpressure pump is not required to maintain sufficient back pressure in the annulus via conduit 124, and flow through the choke system 130, when the flow through the well needs to be shut off for any reason such as adding another drill pipe joint.

Although the invention has been described with reference to a specific embodiment, it will be appreciated that modifications may be made to the system and method described herein without departing from the invention.

The invention claimed is:

1. A drilling system for drilling a bore hole into a subterranean earth formation, the drilling system comprising:

a drill string extending into the bore hole, whereby an annular space is formed between the drill sting and the bore hole wall, the drill string including a longitudinal drilling fluid passage having an outlet opening at the lower end part of the drill string;

a pump for pumping a drilling fluid from a drilling fluid source through the longitudinal drilling fluid passage into the annular space;

a fluid discharge conduit in fluid communication with said annular space for discharging said drilling fluid;

a fluid back pressure system in fluid communication with said fluid discharge conduit; said fluid backpressure system comprising a bypass conduit and a three way valve provided between the pump and the longitudinal drilling fluid passage, whereby the pump is in fluid communication with the fluid discharge conduit via the three way valve and the bypass conduit which bypasses at least part of the longitudinal fluid passage.

2. The drilling system according to claim 1, wherein back pressure control means is provided for controlling delivery of the drilling fluid from the pump via the bypass conduit into the discharge conduit.

3. The system according to claim 1, wherein the fluid back pressure system further comprises a variable flow restrictive device for imposing a flow restriction in a fluid passage, which flow restrictive device is on one side of the flow restriction in fluid communication with both the pump and the fluid discharge conduit.

4. The system according to any one of claims 1, wherein the three way valve is provided in a form comprising a three way fluid junction whereby a first variable flow restricting device is provided between the three way fluid junction and the longitudinal drilling fluid passage and a second variable flow restricting device is provided between the three way fluid junction and the fluid discharge conduit.

5. A method for drilling a bore hole in a subterranean earth formation, comprising:

deploying a drill string into the bore hole, whereby an annular space is formed between the drill string and the bore hole wall, the drill string including a longitudinal drilling fluid passage having an outlet opening at the lower end part of the drill string;

pumping a drilling fluid through the longitudinal drilling fluid passage into the annular space, utilizing a pump in fluid connection with a drilling fluid source;

providing a fluid discharge conduit in fluid communication with said annular space for discharging said drilling fluid;

providing a fluid back pressure system in fluid communication with said fluid discharge conduit; said fluid backpressure system comprising a bypass conduit and a three way valve provided between the pump and the longitudinal drilling fluid passage; and pressurising the fluid discharge conduit utilizing said pump by establishing a fluid communication between the pump and fluid discharge conduit via the three way valve and the bypass conduit thereby bypassing at least part of the longitudinal fluid passage.

6. The method of claim 5, wherein controlling delivery of the drilling fluid from the pump via the bypass conduit into the discharge conduit is controlled by controlling the three way valve.

7. The method of claim 5, wherein the three way valve is provided in a form comprising a three way fluid junction whereby a first variable flow restricting device is provided between the three way fluid junction and the longitudinal drilling fluid passage and a second variable flow restricting device is provided between the three way fluid junction and the fluid discharge conduit, and delivery of the drilling fluid from the pump via the bypass conduit into the discharge conduit is controlled by controlling one or both of the first and second variable flow restricting devices.

8. The method of any one of claim 5, wherein the flow of drilling fluid through the longitudinal fluid passage in the drill string is shut off and pump action of the pump is maintained for pressurising the bypass conduit.

* * * * *